US005097906A

United States Patent [19]

Polan

[11] Patent Number: 5,097,906

[45] **Date of Patent: * Mar. 24, 1992**

[54] CONCEALED AUTOMATIC SPRINKLER

[75] Inventor: George S. Polan, Harleysville, Pa.

[73] Assignee: Central Sprinkler Corporation, Lansdale, Pa.

[ * ] Notice: The portion of the term of this patent subsequent to May 22, 2007 has been disclaimed.

[21] Appl. No.: 535,923

[22] Filed: Jun. 11, 1990

[51] Int. Cl.[5] ..... A62C 37/08

[52] U.S. Cl. ..... 169/37; 169/41; 169/39

[58] Field of Search ..... 169/37–41, 169/90

[56] References Cited

U.S. PATENT DOCUMENTS

| | | | |
|---|---|---|---|
| 278,216 | 5/1883 | Brown | 169/41 |
| 2,389,331 | 11/1945 | Tyden | 169/37 |
| 3,389,884 | 6/1968 | Ault | 169/37 |
| 3,783,947 | 1/1974 | Dix et al. | 169/40 |
| 4,066,129 | 1/1978 | Anderson | 169/37 |
| 4,117,887 | 10/1978 | Anderson | 169/37 |
| 4,215,751 | 8/1980 | Mears | 169/51 |
| 4,596,289 | 6/1986 | Johnson | 169/37 |
| 4,609,047 | 9/1986 | Pieczykolau | 169/38 |
| 4,706,759 | 11/1987 | Grasseschi | 169/51 |
| 4,926,946 | 5/1990 | Polan | 169/37 |
| 4,977,963 | 12/1990 | Simons | 169/37 |

OTHER PUBLICATIONS

Catalog insert "Viking Technical Data Micromatic ® Model a Concealed Sprinkler"; Sprinkler 23, Sprinkler 24, Form No. 011089, 2 pages, Jul. 31, 1989; The Viking Corporation Fire Extinguishing Systems–Automatic Sprinklers.

*Primary Examiner*—Joseph F. Peters, Jr.
*Assistant Examiner*—Christopher P. Ellis
*Attorney, Agent, or Firm*—Panitch Schwarze Jacobs & Nadel

[57] ABSTRACT

A concealed frame-type automatic sprinkler with adjustable cover is provided by a sprinkler with a sprinkler body, an outlet on one side of the sprinkler body, a frame which extends from the body completely around the outlet, a plug retained in the outlet by a heat-sensitive element, and a pair of spring clips retained on the sprinkler by an adjustment screw passed through the frame to preload the heat-responsive element against the plug. The clip members are diametrically opposed and extend radially outwardly on either side of the frame. Each includes a pair of arms with tabs sized and positioned to engage with ribs provided on an inner cylindrical surface to a central cylindrical bracket member provided on an inner side of the cover. A gauge bracket may be mounted on the sprinkler to assure a deflector of the sprinkler is located at a proper height with respect to the ceiling through which the sprinkler extends.

13 Claims, 2 Drawing Sheets

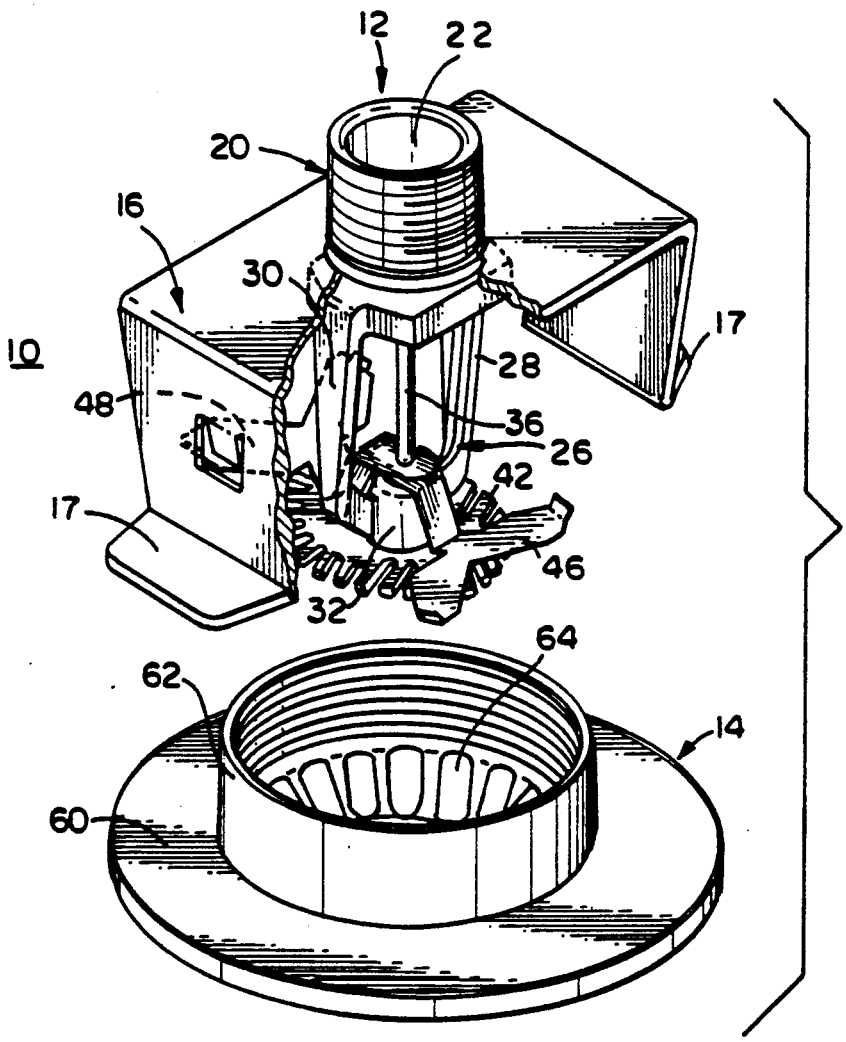
FIG. 1
FIG. 2
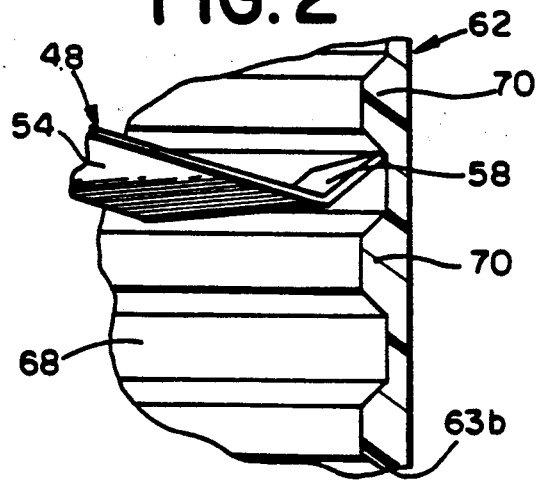

CONCEALED AUTOMATIC SPRINKLER

FIELD OF THE INVENTION

The invention relates to automatic sprinklers and, in particular, to concealed, frame-type sprinklers with adjustable covers.

BACKGROUND OF THE INVENTION

Frame-type automatic sprinklers are well known and have been widely used as ceiling sprinklers in all types of environments. Generally speaking, a frame-type automatic sprinkler includes a sprinkler body having an outlet on one side and a closed frame extending from the sprinkler body around the outlet. A plug is received in the outlet. A heat-sensitive element extends generally between the plug and the frame, biasing the plug into the outlet. The heat-sensitive element changes physical form when sufficiently heated to release the plug from the outlet. The element is typically a frangible, alcohol-filled, glass ampule which breaks but may be an alloy with a low melting point. The outlet, plug and heat-sensitive member are generally axially aligned with one another and with an adjustment screw extending through the frame. The screw adjusts the load that is applied to the plug by the heat sensitive element to resist the pressure of the water or other fire-retarding fluid to be delivered to the sprinkler.

Frame-style sprinklers are often installed in residential and commercial locations where aesthetics are a consideration. To improve the appearance of such sprinklers, covers are sometimes provided to conceal the sprinkler and the ceiling opening while the sprinkler is not operating. During a fire, the cover must drop away from the sprinkler, at least by the time the sprinkler activates, so as not to interfere with the delivery of water or other fire-retarding fluid from the sprinkler.

One approach which has been widely used for supporting a cover from such sprinkler has been to provide an outer housing or yoke about the frame of the sprinkler and supporting a cover from that outer housing or yoke. This is shown, for example, in U.S. Pat. Nos. 3,393,746, 3,998,273, 4,014,388 and 4,706,759. U.S. Pat. Nos. 3,727,695 and 4,215,751 disclose variations on this theme where a flange is provided between the frame and the sprinkler body with which an elongated cover member engages.

Both types of mounting have the disadvantage of being particularly bulky. The former typically requires a larger opening to receive the housing or yoke, which must be extended around the frame of the sprinkler. The latter requires a tall cover or cover with tall bracket arms which can extend above the frame of the sprinkler to engage the flange. Again, the ceiling opening must be sufficiently enlarged to receive the cover and/or its arms.

One approach which has recently been introduced has been to provide a cover with a ceiling plate and a pair of centrally located, opposing, transverse bracket members. Each bracket member is made from metal alloy with heat-activated "memory". Each of the bracket members has a pair of spaced, upstanding arms, each arm having an upper edge turned inwardly towards the center of the cover. The inwardly-turned edges can be snapped over a circular deflector which is typically provided on frame-style sprinklers, supported on a lower side of the frame. When the cover is heated to a sufficiently high temperature, the memory of the alloy of the bracket members causes the bracket member arms to deflect radially outwardly, releasing the arms and cover from the deflector. The temperature-sensitive element used to trigger the activation of the sprinkler is then exposed to the heated gases to which the cover was previously exposed.

This approach offers the distinct advantage of compact size and simplicity. However, the alloys required to construct the cover are considerably more expensive than the materials such as copper, brass, plastic, etc., commonly used to construct such a cover. Moreover, there is always the possibility that the deflections "memorized" in the alloy may change over time, due to an exposure to environmental conditions and/or natural changes occurring in the alloy. The failure of such a cover to release at the proper temperature can totally negate the effectiveness of the sprinkler.

SUMMARY OF THE INVENTION

The invention is a concealed automatic ceiling sprinkler comprising a sprinkler and cover. The sprinkler includes a body having an outlet on one side thereof and a plug received in the outlet. The sprinkler further includes a frame extending from the sprinkler body around the outlet and the plug. A heat-sensitive element extends generally between the plug and the frame. The element biases the plug into the outlet. The element changes physical form when sufficiently heated for releasing the plug from the outlet. An adjustment screw in the frame is provided for adjusting the load applied to the plug by the heat-sensitive element. The sprinkler further includes clip means mounted on the frame for receiving and supporting the cover from the sprinkler. The cover includes a ceiling plate and bracket means extending transversely from the ceiling plate to the clip means for coupling the ceiling plate with the clip means.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings:

FIG. 1 depicts diagrammatically in an exploded isometric view a concealed automatic sprinkler according to the present invention including a sprinkler and separate cover;

FIG. 2 is a diagrammatic side elevation of the cover and sprinkler of FIG. 1 mated together and partially broken away;

DETAILED DESCRIPTION OF THE PREFERRED EMBODIMENT

Figure 3:
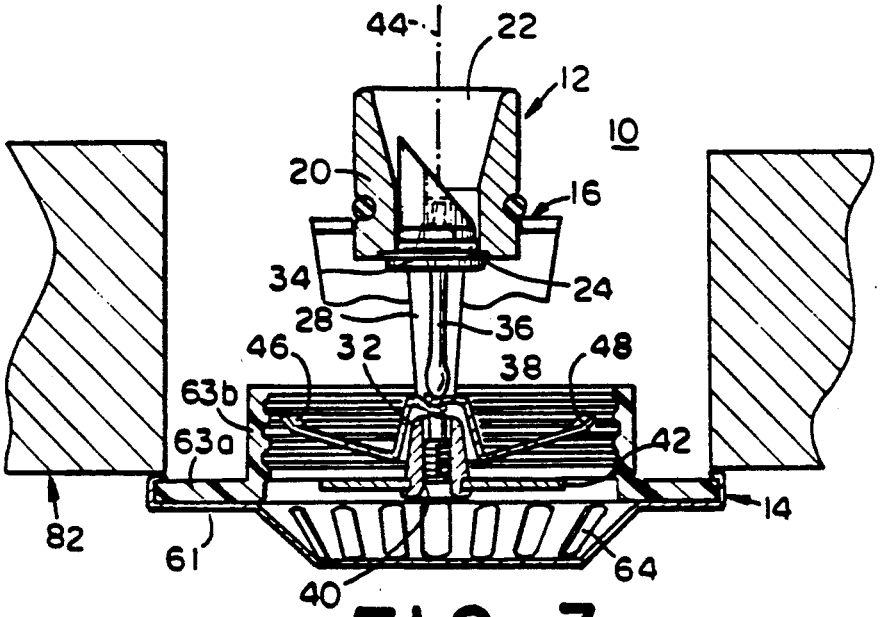
FIG. 3 depicts diagrammatically in enlarged detail, the interference fit engagement between the sprinkler and the cover permitting the cover to be supported from the sprinkler.

In the drawings, like numerals are employed to indicate the same elements throughout. This invention is related to my invention disclosed in U.S. patent application Ser. No. 07/268,911 filed Nov. 8, 1988, which is incorporated by reference.

FIG. 1 depicts in exploded form the components of a concealed automatic ceiling sprinkler indicated collectively at 10. The major components of the ceiling sprinkler include a frame-style sprinkler, indicated generally at 12, and a cover, indicated at 14. If desired, a gauge bracket 16 may be optionally provided on the sprinkler 12 to assist in positioning the sprinkler 12 at the proper height with respect to a ceiling (not depicted).

The sprinkler 12 includes a sprinkler body indicated generally at 20. The body 20 includes an inlet 22 and an opposing outlet 24, seen in FIG. 3. Extending away from the sprinkler 20 from its outlet side is a frame, indicated generally at 26, comprising a pair of arms 28 and 30 coupling together at a joint or knuckle 32. The frame 26 is closed, extending from the body 20 around the outlet 24 and a plug, indicated at 34 in FIG. 3, received in the outlet 24 for sealing the sprinkler. The plug 34 is biased into the outlet 24 by a heat-sensitive element 36. The element 36 changes physical form when sufficiently heated for releasing the plug 34 from the outlet 24. Preferably, the element 36 is a frangible ampule filled with a suitable fluid, such as alcohol, which will vaporize at a predetermined temperature within the ampule, shattering the ampule. Alternatively, the element could be an alloy or other material which will soften sufficiently at a predetermined temperature to release the plug 34 from the outlet 24.

Referring to FIG. 3, an adjustment screw 38 is provided in a threaded bore 40 extending through the knuckle 32 for adjusting the compressive load applied to the plug 34 through the heat-sensitive element 36. Fixedly secured to the frame 26 on a lower side of the knuckle 32 is a deflector plate 42, which disperses the fire-retarding fluid released through the outlet radially outwardly from the sprinkler about a central axis of the sprinkler indicated at 44 in FIG. 3. Typically, each of the foregoing elements of the sprinkler 12 are symmetric or concentric with respect to the central axis 44. Also, each of the previously described elements are conventional to frame-style sprinklers.

According to the invention, the sprinkler 12 further comprises clip means preferably provided by a pair of identical clip members 46 and 48. The clip means members 46, 48 are mounted to the frame 26 of sprinkler 12 with the heat-sensitive element 36 and adjustment screw 38. Preferably, the clip members 46 and 48 are clamped directly between adjoining ends of the heat-sensitive element 36 and the adjustment screw 38, as is best seen in FIG. 3.

Figure 4:
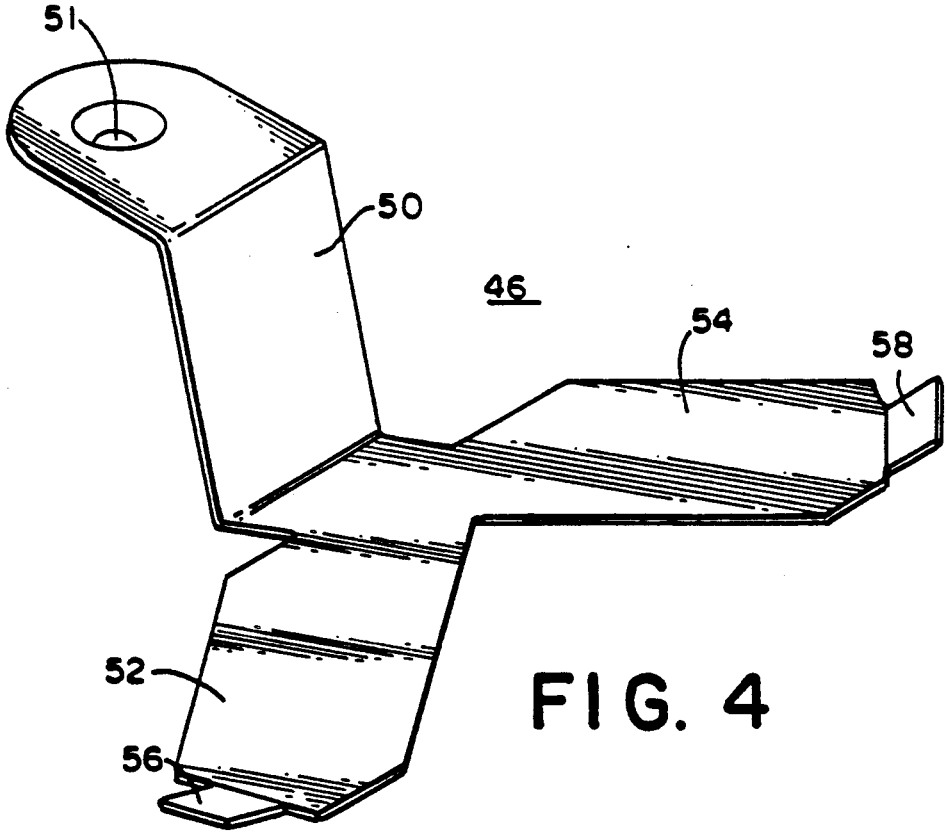
FIG. 4 is a perspective diagrammatic view of one clip.

A single clip member 46 is shown in FIG. 4 for convenience. Preferably, the clip member 46 is generally "Y" shaped. The clip member 46 includes a base 50 and a pair of arms 52 and 54 extending symmetrically away from the base 50. At the extreme free end of each arm 52 and 54 a narrower, bent tab 56 and 58 is preferably provided. Each clip member 46 and 48 is clamped between the element 36 and screw 38 at a free end of the base 50. Between that free end and the arms 52 and 54 the base is preferably bent twice in transverse directions, once in a first direction adjoining the extreme free end of the base 50 and the second in an opposite direction proximal the arms 52 and 54. This is to cant the clip members 46 and 48 upwardly when mounted on the sprinkler 12 to permit the cover 14 to ride up easily over the tabs 56 and 58 when mounting the cover. Preferably, a dimple 51 is provided in the base 50. This mates with the dimple in the other clip 48 and rests in a recess provided at the head of the adjustment screw 48. An identical dimple in clip 48 receives the proximal end of frangible element 36. Preferably, the clip member 46 and 48 are formed from a resiliently flexible material to permit the members 46 and 48 to be cammed inwardly when the cover 14 is being attached in a manner to be described.

Referring to FIG. 1, cover 14 includes a ceiling plate portion, indicated generally at 60, extending generally perpendicularly to central axis 44, and bracket means, indicated generally at 62, extending transversely from a major side of the ceiling plate portion 60 towards the clip means provided by clip members 46 and 48. Bracket means 62 is provided for coupling the ceiling plate portion 60 with the clip means members 46 and 48. Preferably, ceiling plate portion 60 includes a plurality of openings, provided by slots 64, which permit heat to pass through the ceiling plate 60 to the heat-sensitive element 36. As is best seen in FIG. 3, preferably the cover 14 is provided by an outer metal member 61, which forms the lower outer side of the ceiling plate portion 60, and a plastic insert including an annular flange portion 63*a* received on the metal member 61 and a perpendicularly extending cylindrical collar portion 63*b* forming bracket means 62. Preferably, the insert is coupled with the metal member 61 by conventional means such as a turned edge, as indicated, or an adhesive, tabs or other conventional bonding or mechanical securing arrangements.

Referring to FIG. 2, the cylindrical tube portion 63*b* of the bracket means 62 includes an inner cylindrical surface 68 upon which are formed a plurality of spaced, generally circular ribs indicated at 70, which can be interferingly engaged by tab 58 of clip 48. Engagement of tab 56 on each clip 46 and 48 is identical. The inner cylindrical surface can also be viewed as being the innermost surface in the FIGURE in which a plurality of grooves are formed. The structures are viewed as equivalent, if not identical. The ribs 70 and tabs 56 and 58 of each clip member 46 and 48 constitute engagement means for coupling the bracket means with the clip means and supporting the cover 14.

The clip members 46 and 48 extend radially outwardly in opposite directions from the central axis 44. The clips 46 and 48 are sized and positioned so that the tab members 56 and 58 contact the inner cylindrical surface 68 so as to interferingly engage with any selected one of the circular ribs 70.

Fabrication of the concealed sprinkler 10 is straightforward. The sprinkler 12 is entirely conventional except for the addition of the clip members 46 and 48. These may be made in any conventional fashion such as cutting and bending spring-tempered sheet metals such as brass, copper, bronze or stainless steel and the dimple 51 provided. Bases 50 of the two clip members 46 and 48 are overlapped with the dimples 51 aligned along the central axis 44 whereby the convex side of the dimples 51 are received in a hollow conventionally provided at the tip of the adjustment screw 38 for receiving the heat-sensitive element 36 while the lower end of the heat-sensitive element 36 is received in the concave side of the dimple 51. The adjustment screw 38 is thereafter torqued to specification to preload the plug 34 sufficiently to prevent leakage through the outlet 24. The cover 14 is fabricated and, if necessary, assembled in a conventional fashion for the material(s) selected.

In the field, the sprinkler 12 is conventionally installed. Because it is important that the deflector 42 be located at least one-quarter inch below the finished ceiling line, gauge bracket 16 is provided to assure proper installation. Referring to FIG. 1, the flanges 17 on the gauge bracket 16 are intended to contact or hang below the finished ceiling line defined by the lower surface of a ceiling through which sprinkler 12 is installed. If it is not possible to adequately tighten the sprinkler 12 onto the fire-retarding fluid supply pipe or drop nipple 84 with the flanges 17 at or below the ceiling surface 82, then an adjustment to the lower height of the drop nipple 84 must be made to insure the proper spacing. After proper installation of the sprinkler 12, the cover 14 is installed by centering the cylindrical collar portion **63*b* approximately tangentially with the clip members 46 and 48 and pressing the cover 14 upwardly towards the sprinkler 12 until the annular flange portion 63*a* contacts the flanges 17 of the gauge bracket 16 or the ceiling, if bracket 16** is omitted.

The concealed sprinkler 10 typically activates as follows. Heated gas from a fire rises to the ceiling 82 and seeks a means of further escape. The heated gas is funneled through the slots 64 in the ceiling plate 60 to the heat-sensitive element 36 When the heat-sensitive element 36 is heated sufficiently, it fractures or softens, freeing both clip members 46 and 48. The weight of the cover 14 causes the clip members 46 and 48 to pivot off of the frame 26 and drop away. If clip members 46 and 48 do not fall away, then they, plug 34 and the remains of element 36 are blown or are washed away by the ensuing release of fire-retarding fluid.

The spaced circular ribs 70 should extend over a height of at least about one-quarter inch to provide the minimum desired height adjustment for such installations and preferably extend over a height of at least ⅜ to ½ inch.

From the foregoing description, it can be seen that the present invention provides a simple means for directly coupling an adjustable, fall-away cover to a frame-style sprinkler. It will be recognizes by those skilled in the art that changes could be made to the above-described embodiment without departing from the broad, inventive concepts thereof. It is understood, therefore, that this invention is not limited to the particular embodiment disclosed, but is intended to cover any modifications which are within the scope and spirit of this invention, as defined by the appended claims.

I CLAIM:

1. A concealed automatic ceiling sprinkler comprising:

a sprinkler including a body having an outlet on one side thereof, a plug received in the outlet, a frame extending from the sprinkler body around the outlet and the plug, a heat-sensitive element extending generally between the plug and the frame, biasing the plug into the outlet, the heat-sensitive element changing physical form when sufficiently heated for releasing the plug from the outlet, an adjustment screw in the frame for adjusting the load applied to the plug by the heat-sensitive element, and clip means mounted on the frame for supporting a cover from the sprinkler; and the cover including a ceiling plate portion and bracket means extending transversely from the ceiling plate portion to the clip means for coupling the ceiling plate portion with the clip means.

2. The sprinkler of claim 1 wherein the bracket means are held on the frame between the heat sensitive element and one of the plug and the adjustment screw.

3. The sprinkler of claim 2 wherein the clip means comprises two separate clip members held together with the heat-sensitive element so as to extend in opposite directions from the heat-sensitive element to the bracket means.

4. The sprinkler of claim 2 wherein the clip means comprises two clip members clamped together between the adjustment screw and the heat-sensitive element.

5. The sprinkler of claim 4 wherein the two clip members extend in opposite directions from the heat-sensitive element to the bracket means.

6. The sprinkler of claim 1 wherein the bracket means including a plurality of ribs along a side of the bracket means facing the clip means.

7. The sprinkler of claim 6 further comprises a tab on the clip means engageable with any selected one of the ribs.

8. The sprinkler of claim 1 wherein the ceiling plate includes a plurality of openings to permit heated gas to pass through the ceiling plate portion to the heat-sensitive element.

9. The sprinkler of claim 1 wherein the bracket means comprises a cylindrical collar portion secured to the ceiling plate portion.

10. The sprinkler of claim 9 wherein the cylindrical collar portion has an inner cylindrical surface and a plurality of spaced, generally circular ribs, molded into the inner cylindrical surface.

11. The sprinkler of claim 10 wherein the ceiling plate portion includes a plurality of openings to permit heated gas to pass through the ceiling plate portion to the heat-sensitive element.

12. The sprinkler of claim 11 wherein the clip means comprises two separate clip members clamped between the adjustment screw and the heat-sensitive element.

13. The sprinkler of claim 12 wherein each clip member is resiliently flexible and includes at least one tab interferingly engaged with one of the ribs of the inner cylindrical surface.

* * * * *